US007724076B2

(12) United States Patent
Byeon

(10) Patent No.: US 7,724,076 B2
(45) Date of Patent: May 25, 2010

(54) INTERNAL VOLTAGE GENERATOR OF SEMICONDUCTOR INTEGRATED CIRCUIT

(75) Inventor: Sang-Jin Byeon, Gyeonggi-do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 7 days.

(21) Appl. No.: 11/819,424

(22) Filed: Jun. 27, 2007

(65) Prior Publication Data

US 2008/0061856 A1 Mar. 13, 2008

(30) Foreign Application Priority Data

Sep. 13, 2006 (KR) ..... 10-2006-0088749

(51) Int. Cl.
*G05F 1/10* (2006.01)

(52) U.S. Cl. ..... 327/541; 327/540

(58) Field of Classification Search ..... 327/540–543
See application file for complete search history.

(56) References Cited

U.S. PATENT DOCUMENTS

| | | | | |
|---|---|---|---|---|
| 5,121,007 | A * | 6/1992 | Aizaki | 327/544 |
| 5,295,112 | A * | 3/1994 | Taniguchi | 365/227 |
| 5,347,170 | A * | 9/1994 | Hayakawa et al. | 327/541 |
| 5,440,254 | A * | 8/1995 | Sundby | 327/79 |
| 5,463,588 | A * | 10/1995 | Chonan | 365/226 |
| 5,804,893 | A * | 9/1998 | Fujioka | 307/125 |
| 5,907,283 | A * | 5/1999 | Kim | 340/661 |
| 5,994,950 | A * | 11/1999 | Ochi | 327/543 |
| 6,079,023 | A | 6/2000 | Yoon et al. | |
| 6,184,744 | B1 * | 2/2001 | Morishita | 327/541 |
| 6,285,176 | B1 * | 9/2001 | Marx et al. | 323/313 |
| 6,515,461 | B2 * | 2/2003 | Akiyama et al. | 323/313 |
| 6,778,460 | B1 | 8/2004 | Jung | |
| 6,885,235 | B2 * | 4/2005 | Tomishima et al. | 327/538 |
| 6,891,773 | B2 | 5/2005 | Park | |
| 6,956,304 | B2 * | 10/2005 | Brox | 307/87 |
| 6,963,230 | B2 * | 11/2005 | Morishita | 327/77 |
| 7,173,480 | B2 | 2/2007 | Kim et al. | |
| 7,250,811 | B2 * | 7/2007 | Kim | 327/538 |
| 7,349,190 | B1 * | 3/2008 | Maheedhar et al. | 361/92 |
| 7,414,897 | B2 * | 8/2008 | Do | 365/189.09 |
| 2006/0221749 | A1 * | 10/2006 | Kwean | 365/226 |
| 2007/0025163 | A1 | 2/2007 | Partsch et al. | |
| 2008/0001653 | A1 * | 1/2008 | Lee et al. | 327/541 |
| 2009/0168585 | A1 * | 7/2009 | Kang | 365/226 |

FOREIGN PATENT DOCUMENTS

| | | |
|---|---|---|
| JP | 11203876 | 7/1999 |
| KR | 1020020024914 | 4/2002 |

* cited by examiner

*Primary Examiner*—Lincoln Donovan
*Assistant Examiner*—Thomas J Hiltunen
(74) *Attorney, Agent, or Firm*—Venable LLP; Jeffri A. Kaminski

(57) ABSTRACT

An internal voltage generator of a semiconductor integrated circuit includes a first driver that outputs an internal voltage by using an internal reference voltage during an active operation in accordance with a detection signal generated by using an external voltage and an active enable signal activated during an activation mode, and a second driver that outputs an internal voltage by using the internal reference voltage during the active operation in accordance with the active enable signal.

21 Claims, 2 Drawing Sheets

INTERNAL VOLTAGE GENERATOR OF SEMICONDUCTOR INTEGRATED CIRCUIT

CROSS-REFERENCE TO RELATED APPLICATION

This application claims priority from Korean Patent Application No. 10-2006-0088749 filed on Sep. 13, 2006 in the Korean Intellectual Property Office, the disclosure of which is incorporated herein by reference in its entirety.

BACKGROUND OF THE INVENTION

1. Technical Field

The present invention relates to a semiconductor integrated circuit, and more particularly, to an internal voltage generator that is supplied with an external voltage and generates an internal voltage which is used in a semiconductor integrated circuit.

2. Related Art

In general, an internal voltage generator is supplied with an external voltage VDD, and generates an internal voltage VINT whose potential level may be various different levels. Specifically, the internal voltage generator is supplied with a high external voltage and generates a low internal voltage for an internal circuit. A semiconductor integrated circuit operates by using the low internal voltage. Therefore, it is possible to reduce power consumption of the semiconductor integrated circuit and improve a function thereof.

The internal voltage generator that generates the internal voltage may include various drivers. For example, the drivers may include a standby driver and an active driver. The standby driver may be a small-amount driver that is constantly activated to supply an internal voltage, but has low power consumption. Generally, a discharge transistor, through which a current of a few microamperes flows, is used in the standby driver. The reason why the discharge transistor is used is to stably maintain the internal voltage so as to stably perform a circuit operation.

The active driver may be a large-amount driver that sufficiently supplies an internal voltage during an active mode when the semiconductor integrated circuit is operated. In particular, because of the power consumption, the active driver only operates when the semiconductor integrated circuit becomes active, which reduces the amount of current that flows through the active driver.

When the semiconductor integrated circuit becomes active, the active driver is activated. Further, as circuits using the internal voltage VINT operate, an external voltage needs to be supplied. However, because of an operational characteristic of the active driver which supplies a large amount of current, the active driver may supply an excess voltage with respect to the required internal voltage. In this case, the discharge circuit that is included in the standby driver discharges the excess voltage so as to maintain the internal voltage at a predetermined potential level. However, it may take too long of a time to discharge the excess voltage by using only the discharge circuit. Further, area efficiency of the semiconductor integrated circuit may decline due to the additional discharge circuit.

SUMMARY OF THE INVENTION

Embodiments of the invention provide an internal voltage generator of a semiconductor integrated circuit that is capable of preventing a current from being wastefully used and stably supplying an internal voltage.

According to one embodiment, an internal voltage generator includes a first driver that outputs an internal voltage by using an internal reference voltage during an active operation in accordance with a detection signal generated by using an external voltage and an active enable signal activated during an activation mode, and a second driver that outputs an internal voltage by using the internal reference voltage during the active operation in accordance with the active enable signal.

According to another embodiment, the internal voltage generator includes a level detector that detects an external voltage so as to generate a detection signal, and a first driver that generates an internal voltage by using an internal reference voltage in accordance with an active enable signal activated during an activation mode and the detection signal. When a potential level of the external voltage is higher than a potential level of the internal reference voltage, the detection signal inactivates the first driver.

BRIEF DESCRIPTION OF THE DRAWINGS

The above and other features and advantages of the invention will become more apparent by describing in detail exemplary embodiments thereof with reference to the attached drawings in which.

DETAILED DESCRIPTION OF EXEMPLARY EMBODIMENT

Figure 1:
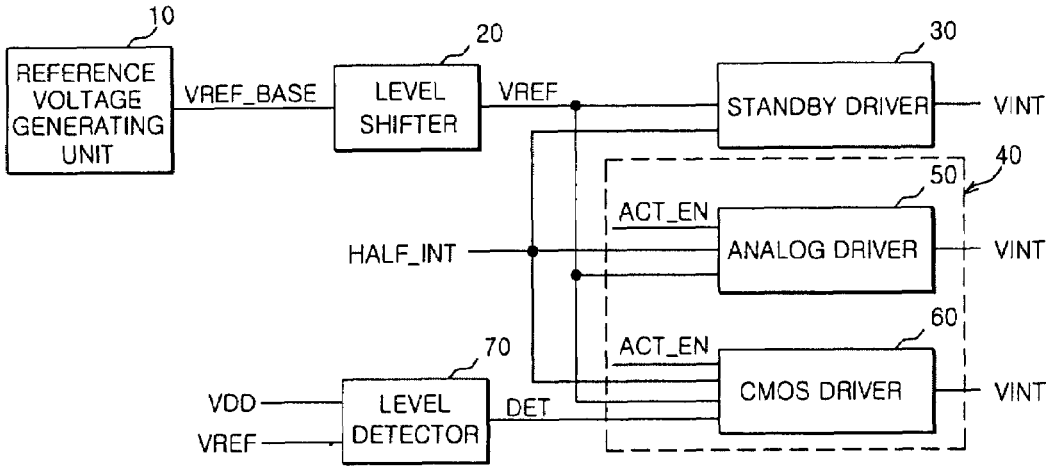
FIG. 1 is a block diagram illustrating an internal voltage generator according to an embodiment of the present invention.

The attached drawings for illustrating preferred embodiments of the present invention are referred to in order to gain a sufficient understanding of the present invention, the merits thereof, and the objectives accomplished by the implementation of the present invention.

Hereinafter, the present invention will be described in detail by explaining preferred embodiments of the invention with reference to the attached drawings. Like reference numerals in the drawings denote like elements.

As shown in FIG. 1, an internal voltage generator according to an embodiment of the present invention includes a reference voltage generating unit 10, a level shifter 20, a standby driver 30, an active driver 40, and a level detector 70.

First, the reference voltage generating unit 10 outputs a reference voltage VREF_BASE that has a predetermined potential level. The reference voltage generating unit 10 may include a bipolar-type reference voltage generator or a MOS-type reference voltage generator. In this embodiment, a bipolar-type band-gap reference voltage generating unit that compensates for a temperature using a temperature coefficient is exemplified, but the present invention is not limited thereto. The reference voltage generating unit can be understood by those who are skilled in the art, and thus the detailed description thereof will be omitted.

The level shifter 20 receives the reference voltage VREF_BASE that is output by the reference voltage generating unit 10 and outputs an internal reference voltage VREF. In this case, the internal reference voltage VREF of the level shifter 20 has a voltage level that is shifted by the reference voltage VREF_BASE. The level shifter 20 may include a trimming unit (not shown) that performs trimming to be a desired potential using the reference voltage VREF_BASE. The level shifter 20 may further include a buffering unit (not shown). The buffering unit may buffer the trimmed reference voltage VREF_BASE for use in an internal circuit.

The standby driver 30 is constantly activated to supply an internal voltage VINT regardless of operational state of the semiconductor integrated circuit by using the internal reference voltage VREF. Accordingly, the standby driver 30 may be a small-amount driver that has small power consumption. The standby driver 30 compares the internal reference voltage VREF and a half internal voltage HALF_VINT. The half internal voltage HALF_VINT has a voltage level corresponding to half as much as a voltage level of the internal voltage VINT. Thus, the standby driver 30 is supplied with an external voltage VDD and gradually increases the potential of the interval voltage VINT when a potential of the half internal voltage HALF_VINT is lower than a potential of the internal reference voltage VREF. Vice versa, the standby driver 30 blocks the supply of the external voltage VDD such that the potential of the internal voltage VINT is no longer increased when the potential of the half internal voltage HALF_VINT is increased to become equal to or higher than the potential of the internal reference voltage VREF.

During an active mode, the active driver 40 supplies the internal voltage VINT by using the internal reference voltage VREF, and may be a large-amount driver that has larger power consumption than the standby driver 30. In this embodiment, the active driver 40 includes an analog driver 50 and a CMOS driver 60. The active driver 40 only operates during an interval where an active enable signal ACT_EN is activated, such that the active driver 40 operates during the active mode. The active enable signal ACT_EN enters the active mode and is activated during a precharge interval.

The analog driver 50 compares the internal reference voltage VREF and the half internal voltage HALF_VINT to supply the internal voltage VINT, and is activated according to the active enable signal ACT_EN. Similar to the above-described operation of the standby driver 30, the analog driver 50 compares the potential of the half internal voltage HALF_VINT and the potential of the internal reference voltage VREF and supplies or blocks the supply of the external voltage VDD according to whether the potential of the half internal voltage HALF_VINT is lower or higher than the potential of the internal reference voltage VREF, such that the internal voltage VINT is stably supplied.

As described above, the analog driver 50 and the CMOS driver 60 operate during the active mode, that is, an activation mode. The analog driver 50 may be a driver that slightly turns on a driving transistor by using a signal having a small swing width and has a small driving force. However, the CMOS driver 60 may be a driver that fully turns on a driving transistor and has a large driving force. Generally, in a low voltage region, the driving force of the active driver 40 is lowered, which becomes unstable to supply the internal voltage VINT by only the analog driver 50. Accordingly, if simultaneously using both the analog driver 50 and the CMOS driver 60 having a large driving force, the driving force can be improved. However, when applying the external voltage VDD in excess of an external voltage VDD required by the internal circuit, the power consumption is increased due to supplemental driving of the CMOS driver 60 having a large driving force. As a result, a discharge circuit needs to operate to discharge the excess external voltage supplied from the external voltage terminal VDD. Accordingly, in regards to the CMOS driver 60 having large power consumption, it is effective to divide intervals according to a detection signal DET detected by using the external voltage VDD and selectively operate the CMOS driver 60 in terms of the reduction in the power consumption.

In this embodiment, the CMOS driver 60 compares the internal reference voltage VREF and the half internal voltage HALF_VINT to supply the internal voltage VINT, and is activated according to the detection signal DET generated by using the external voltage VDD and the active enable signal ACT_EN. The CMOS driver 60 can be controlled on whether or not to activate the operation of the CMOS driver 60, according to the detection signal DET that is detected by using the external voltage VDD. That is, when the high voltage is supplied from the external voltage terminal VDD, the CMOS driver 60 is inactivated according to the detection signal DET, thereby reducing the power consumption.

The level detector 70 compares the external voltage VDD and the internal reference voltage VREF and generates the detection signal DET for activating the CMOS driver 60 according to the compared result, and supplies the detection signal DET to the CMOS driver 60, which will be described in detail below.

Accordingly, the analog driver 50 operates according to the active enable signal ACT_EN that is activated when the semiconductor integrated circuit is in the active mode, similar to the related art. However, the CMOS driver 60 is controlled to be either activated or inactivated according to the active enable signal ACT_EN and the detection signal DET generated according to the potential level of the external voltage VDD.

The operation of the level detector 70 and the CMOS driver 60 will now be described with reference to the circuit diagrams of FIGS. 2 and 3.

Figure 2:
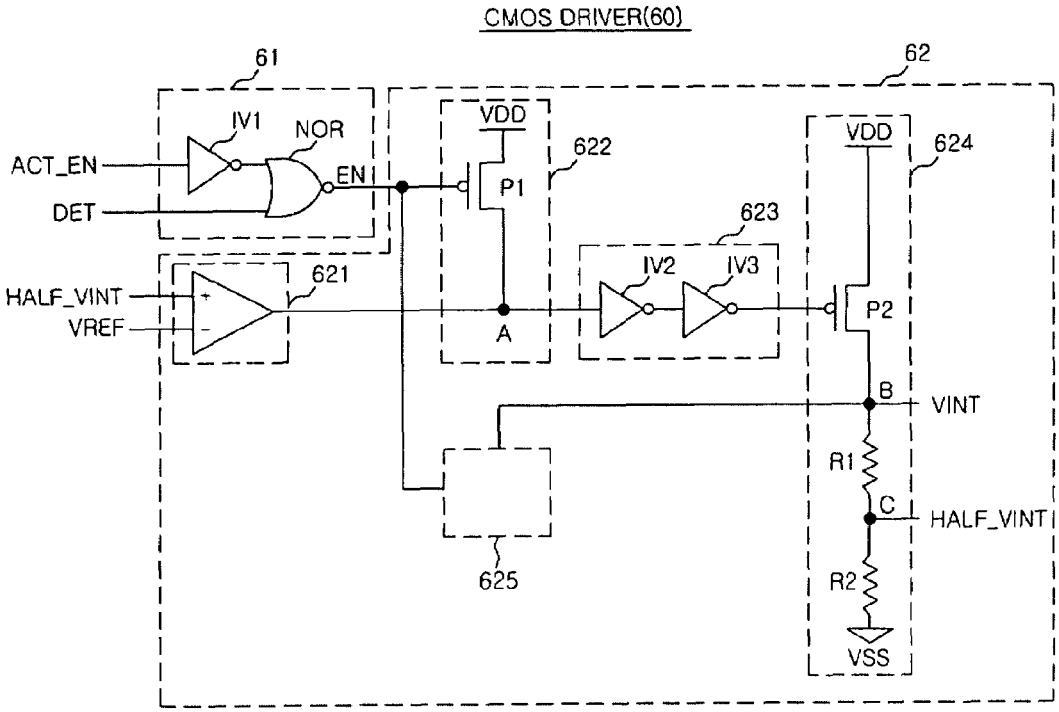
FIG. 2 is a circuit diagram of a CMOS driver shown in FIG. 1.

First, as shown in FIG. 2, the CMOS driver 60 includes a control unit 61 and a driving unit 62.

The control unit 61 generates an enable signal EN according to the detection signal DET and the active enable signal ACT_EN.

The control unit 61 includes an inverter IV1 that inverts the active enable signal ACT_EN and a NOR gate NOR that receives an output signal of the inverter IV1 and the detection signal DET. During an interval where the active enable signal ACT_EN is activated, the control unit 61 can supply an enable signal EN that has an inverted voltage level of a voltage level of the detection signal DET according to the signal level of the detection signal DET. That is, when the control unit 61 receives the high-level detection signal DET during an interval where the active enable signal ACT_EN is activated, the control unit 61 outputs the activated low-level enable signal EN. However, when the control unit 61 receives the low-level detection signal DET during an interval where the active enable signal ACT_EN is activated, the control unit 61 supplies the inactivated high-level enable signal EN.

If the driving unit 62 receives the enable signal EN, it is possible to control the driving unit 62 to be either activated or inactivated.

The driving unit 62 includes a comparing unit 621, an enable signal receiving unit 622, a delay unit 623, an output unit 624, and a noise preventing circuit unit 625.

First, the comparing unit 621 compares the half internal voltage HALF_VINT and the internal reference voltage VREF and supplies an output signal as the compared result to a node A. In this case, the comparing unit 621 may be a current-mirror-type differential amplifier, but the present invention is not limited thereto. If the half internal voltage HALF_VINT is smaller than the internal reference voltage VREF, the comparing unit 621 supplies a low-level signal to the node A. However, if the half internal voltage HALF_VINT is larger than the internal reference voltage VREF, the comparing unit 621 supplies a high-level signal to the node A.

The enable signal receiving unit 622 includes a first PMOS transistor P1. The first PMOS transistor P1 has a gate that receives the enable signal EN, a source that is connected to the external voltage terminal VDD, and a drain that is connected to the node A. The first PMOS transistor P1 is turned on or turned off according to the received enable signal EN.

The delay unit 623 includes second and third inverters IV2 and IV3. The CMOS driver 60 is different from the analog driver (refer to reference numeral 50 in FIG. 1) in that the CMOS driver 60 includes the delay unit 623. Since the CMOS driver 60 is provided with the delay unit 623, the CMOS driver 60 supplies a signal having a CMOS level and fully turns on the second PMOS P2 that serves as a driving transistor.

The output unit 624 is activated according to the output signal of the delay unit 623. The output unit 624 supplies the internal voltage VINT and the half internal voltage HALF_VINT. The output unit 624 is supplied with the external voltage VDD. The second PMOS transistor P2 of the output unit 624 has a gate that receives the output signal of the delay unit 623, a source that is connected to the external voltage terminal VDD, and a drain that is connected to a node B. Therefore, a signal of the node B according to whether the second PMOS P2 is turned on or not may be supplied as the internal voltage VINT.

Resistors R1 and R2 are connected in series to each other between the node B and a ground voltage terminal VSS. The internal voltage VINT that is applied to the node B is distributed by the resistors R1 and R2, and is then output as the half internal voltage HALF_VINT through a common node C between the resistors R1 and R2. Here, for the convenience of explanation, two resistors R1 and R2 are shown, but two resistors may be provided at each end of the node C according to a circuit structure. Further, resistive components may be replaced by not only active elements but also passive elements.

Meanwhile, the noise preventing circuit unit 625 responds to the enable signal EN that is the output signal of the control unit 61 and prevents noise from occurring at the time of a change in the internal voltage VINT. For example, the noise preventing circuit unit 625 may include a NMOS transistor that has a little current driving force. This NMOS transistor has a channel length that is very long and has large channel resistance. For this reason, since a voltage VDS between a drain and a source of the NMOS transistor is increased, the current driving force may be small. Therefore, the NMOS transistor of the noise preventing circuit unit 625 is slightly turned on while preventing noise from occurring due to the change in the internal voltage VINT. In this embodiment, the noise preventing circuit unit 625 responds to the enable signal EN, but may respond to the reference voltage VREF according to a particular circuit structure. Further, the noise preventing circuit unit 625 may include a capacitor according to a particular circuit structure.

The operation of the driving unit 62 will now be described.

First, it is assumed that the enable signal EN supplied from the control unit 61 is at an inactivated high level. In this case, since the first PMOS transistor P1 is turned off, the potential level of the node A is determined according to the output signal of the comparing unit 621. The comparing unit 621 compares the internal reference voltage VREF and the half internal voltage HALF_VINT. At this time, if the potential of the half internal voltage HALF_VINT is lower than the potential of the internal reference voltage VREF, the comparing unit 621 supplies a low-level signal to the node A. When the second PMOS transistor P2 is turned on, and the driving unit 62 is supplied with the external voltage VDD and gradually increases the potential of the internal voltage VINT. If the potential of the half internal voltage HALF_VINT of the comparing unit 621 is higher than the potential of the internal reference voltage VREF, the second PMOS transistor P2 is turned off such that the potential of the internal voltage VINT is no longer increased, which allows the internal voltage VINT to be constant.

However, if the enable signal EN as the output signal of the control unit 61 becomes an activated low level and the first PMOS transistor P1 is turned on, a potential level of the node A becomes a high level. At this time, since the analog signal of the comparing unit 621 has a small swing range, the node A is supplied with a high-level signal according to the result of turning on the first PMOS transistor P1. Accordingly, the high-level signal that has passed through the delay unit 623 causes the second PMOS transistor P2 of the output unit 624 to be turned off, which prevents the external voltage VDD from being supplied as the internal voltage VDD.

As such, according to an embodiment of the present invention, the external voltage VDD may or may not be supplied as the internal voltage VINT according to the output signal of the control unit 61. That is, if the CMOS driver 60 is used in the case where the potential level of the external voltage VDD is high, the CMOS driver 60 has a large driving force and thus causes large power consumption. Therefore, the CMOS driver 60 only operates when the external voltage VDD is low.

Figure 3:
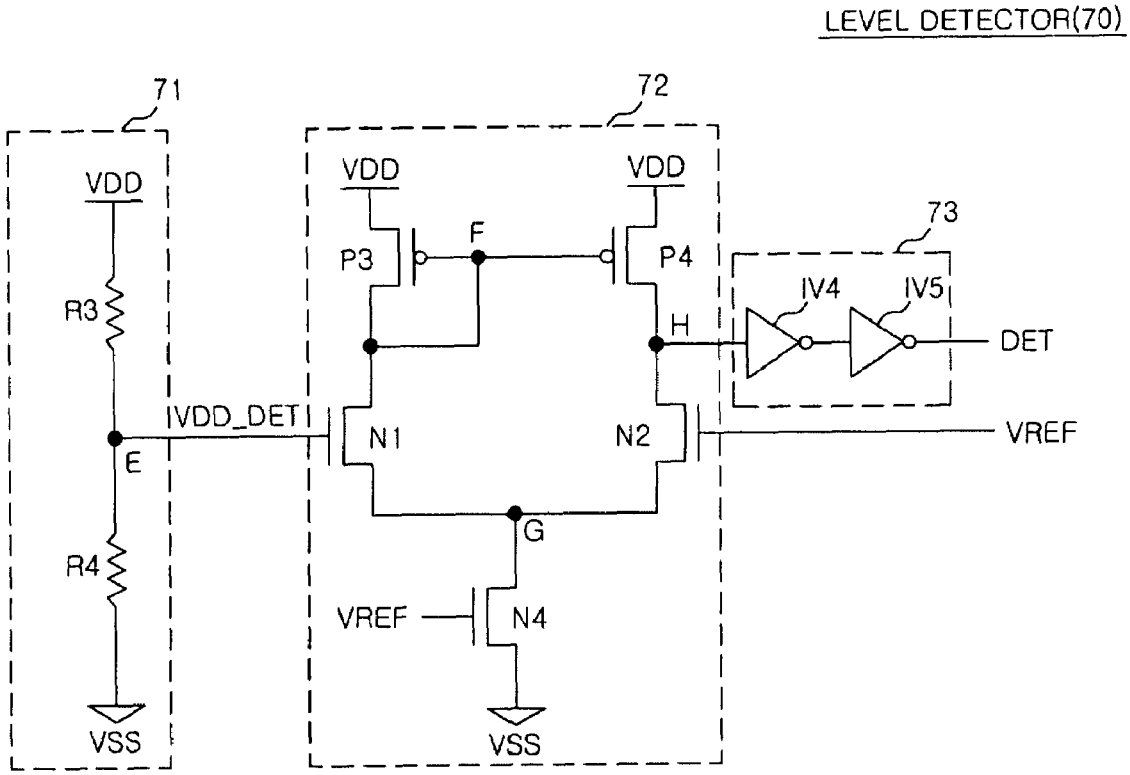
FIG. 3 is a circuit diagram of a level detector shown in FIG. 1.

Referring to FIG. 3, a description is given of the detection signal DET that determines the potential of the enable signal EN of the control unit 61.

Referring to FIG. 3, the level detector 70 performs a differential comparison operation between a detection voltage signal VDD_DET according to the external voltage VDD and the reference voltage VREF and generates the detection signal DET according to the compared result.

The level detector 70 includes a voltage distributing unit 71, a differential comparing unit 72, and a delay unit 73.

As shown in FIG. 3, the voltage distributing unit 71 includes resistor elements R3 and R4 that distribute and output the external voltage VDD. That is, the resistor elements R3 and R4 are connected in series between the external voltage terminal VDD and the ground voltage terminal VSS and supply a voltage distributed by the resistance to a node E.

The differential comparing unit 72 compares a detection voltage signal VDD_DET supplied by the voltage distributing unit 71 and the internal reference voltage VREF and outputs the compared result.

The differential comparing unit 72 includes first and second NMOS transistors N1 and N2 that receive the detection voltage signal VDD_DET and the internal reference voltage VREF, respectively.

The differential comparing unit 72 includes a third PMOS transistor P3 and a fourth PMOS transistor P4 that perform an amplifying operation according to the received signal. Sources of the third PMOS transistor P3 and the fourth PMOS transistor P4 are connected to the external voltage terminal VDD, gates thereof are commonly connected to a node F, and drains thereof are connected to the node F and a node H, respectively.

The differential comparing unit 72 includes a fourth NMOS transistor N4 that controls whether or not to activate the differential comparing unit 72. The fourth NMOS transistor N4 includes a gate that is supplied with the internal reference voltage VREF, a source that is connected to the ground voltage terminal VSS, and a drain that is connected to a node G.

The delay unit 73 includes inverters IV4 and IV5 and delays the output of the differential comparing unit 72 and supplies the detection signal DET.

Since the differential comparing unit 72 of a differential amplifier type can be understood by those who are skilled in the art, the operation thereof will be described in brief. The differential comparing unit 72 compares the detection voltage signal VDD_DET, which is obtained by distributing the potential level of the external voltage VDD using the resistors R3 and R4, and the differential signal of the internal reference voltage VREF. As a result, when the potential level of the detection voltage signal VDD_DET is higher than the potential level of the internal reference voltage VREF, the second NMOS transistor N2 of the differential comparing unit 72 is turned on, and the NODE F becomes a low level. As a result, the fourth PMOS transistor P4 is turned on, and the high-level detection signal DET as the output signal can be supplied. That is, if the external voltage VDD is supplied and a predetermined potential level or more is detected, the high-level detection signal DET is supplied. This detection signal DET inactivates the operation of the CMOS driver (refer to reference numeral 60 of FIG. 2), and blocks supply of the external voltage VDD.

The contrasting case where the potential level of the detection voltage signal VDD_DET is lower than a potential level of the internal reference voltage VREF is now described. In this case, the third NMOS transistor N3 is turned on, and the node H becomes a low level. Accordingly, the detection signal DET that is an output signal of the level detector 70 may be supplied as a low-level signal. The detection signal DET as the low-level signal activates the CMOS driver (refer to reference numeral 60 of FIG. 2) during an interval where the active enable signal ACT_EN is at a high level.

As such, during an interval where a potential level of the external voltage VDD is higher than a potential level of the predetermined voltage, the internal voltage generator operates only the analog driver 50 having a small driving force, and inactivates the CMOS driver 60 in which the driving capability is large and the power consumption is large. That is, only in a low voltage region where the external voltage VDD is smaller than the predetermined voltage, the CMOS driver 60 is activated. Accordingly, since the CMOS driver 60 can be selectively operated according to a value of the external voltage VDD to be applied, it is possible to reduce the power consumption.

It will be apparent to those skilled in the art that various modifications and changes may be made without departing from the scope and spirit of the invention. Therefore, it should be understood that the above embodiments are not limitative, but illustrative in all aspects. The scope of the invention is defined by the appended claims rather than by the description preceding them, and therefore all changes and modifications that fall within metes and bounds of the claims, or equivalents of such metes and bounds are therefore intended to be embraced by the claims.

According to the internal voltage generator of the semiconductor integrator circuit according to an embodiment of the present invention, the CMOS driver having a large driving force can be selectively operated according to a potential level of the external voltage. When the external voltage is small, the driving force can be improved, and when the external voltage is large, the CMOS driver can be inactivated. As a result, it is possible to prevent the current from being wastefully used, which supplies a stable internal voltage.

What is claimed is:

1. An internal voltage generator of a semiconductor integrated circuit, the internal voltage generator comprising:

a first driver that outputs an internal voltage by using a detection signal generated by using an external voltage and a comparing result between an internal reference voltage and a half-internal voltage which is a divided voltage of the internal voltage during an active operation according to an active enable signal; and a second driver that outputs the internal voltage by using the internal reference voltage during the active operation in accordance with the active enable signal, wherein the first driver is inactivated and the second driver is activated when the external voltage is more than a predetermined voltage in the active mode.

2. The internal voltage generator of claim 1, further comprising:

a level detector that detects a potential level of the external voltage to generate the detection signal and provide the detection signal to the first driver.

3. The internal voltage generator of claim 2, wherein the level detector performs a differential comparison between the potential level of the external voltage and a potential level of the internal reference voltage to obtain a compared result, and generates the detection signal according to the compared result.

4. The internal voltage generator of claim 3, wherein the predetermined voltage is the internal reference voltage.

5. The internal voltage generator of claim 4, wherein the level detector comprises:

a voltage distributing unit that distributes the external voltage to provide a distributed voltage; and a differential comparing unit that compares a potential level of the distributed voltage of the voltage distributing unit and the potential level of the internal reference voltage, and outputs the detection signal according to the comparison.

6. The internal voltage generator of claim 5, wherein the level detector further comprises a delay unit that delays the detection signal and inputs the detection signal to the first driver.

7. The internal voltage generator of claim 1, wherein the first driver comprises;

a control unit that supplies an enable signal according to a signal level of the detection signal during an interval where the active enable signal is activated; and a driving unit that selectively generates the internal voltage in response to the enable signal.

8. The internal voltage generator of claim 7, wherein the control unit comprises a NOR gate that receives an inversion signal of the active enable signal and the detection signal, and outputs the enable signal.

9. The internal voltage generator of claim 8, wherein the driving unit comprises:

a comparing unit that compares the internal voltage and the internal reference voltage to provide an output signal;

an enable signal receiving unit that responds to the enable signal output of the control unit to provide an output signal and is controlled based on whether the enable signal receiving unit is activated or not; and an output unit that supplies the internal voltage in response to the output signal of the comparing unit or the output signal of the enable signal receiving unit.

10. The internal voltage generator of claim 1, further comprising:

a reference voltage generating unit that outputs the internal reference voltage having a predetermined potential level according to the external voltage.

11. The internal voltage generator of claim 1, further comprising:

a reference voltage generating unit that outputs a reference voltage having a predetermined potential level according to the external voltage; and a level shifter that receives the reference voltage output by the reference voltage generating unit and outputs the internal reference voltage.

12. The internal voltage generator of claim 1, wherein the first driver is deactivated when the half-internal voltage is larger than the internal reference voltage although the detection signal is enabled.

13. An internal voltage generator of a semiconductor integrated circuit, the internal voltage generator comprising:

a level detector that detects a potential level of an external voltage to generate a detection signal;

a first driver that generates an internal voltage by using the detection signal and a comparing result between an internal reference voltage and a half-internal voltage which is a divided voltage of the internal voltage according to an active enable signal activated during an active mode; and a second driver that outputs the internal voltage by using the internal reference voltage during the active mode in accordance with the active enable signal, wherein the first driver and the second driver have a different driving force respectively, and the first driver which has a larger driving force than the second driver is inactivated when the external voltage is higher than the internal reference voltage in the active mode.

14. The internal voltage generator of claim 13, wherein the first driver comprises;

a control unit that supplies an enable signal according to a signal level of the detection signal during an interval where the active enable signal is activated; and a driving unit that selectively supplies the internal voltage in response to the enable signal.

15. The internal voltage generator of claim 14, wherein the control unit includes a NOR gate that receives an inversion signal of the active enable signal and the detection signal, and outputs the enable signal.

16. The internal voltage generator of claim 15, wherein the driving unit comprises:

a comparing unit that compares the internal voltage and the internal reference voltage to provide an output signal;

an enable signal receiving unit that responds to the enable signal output of the control unit to provide an output signal and is controlled based on whether the enable signal receiving unit is activated or not; and an output unit that supplies the internal voltage in response to the output signal of the comparing unit or the output signal of the enable signal receiving unit.

17. The internal voltage generator of claim 13, wherein the level detector compares the potential level of the external voltage and a potential level of the internal reference voltage to obtain a compared result and outputs the detection signal according to the compared result.

18. The internal voltage generator of claim 17, wherein the level detector comprises:

a voltage distributing unit that distributes the external voltage to provide a distributed voltage; and a differential comparing unit that compares a potential level of the distributed voltage of the voltage distributing unit and the potential level of the internal reference voltage to obtain the compared result and outputs the detection signal according to the compared result.

19. The internal voltage generator of claim 13, further comprising:

a reference voltage generating unit that outputs the internal reference voltage having a predetermined potential level according to the external voltage.

20. The internal voltage generator of claim 13, further comprising:

a reference voltage generating unit that outputs a reference voltage having a predetermined potential level according to the external voltage; and a level shifter that receives the reference voltage output by the reference voltage generating unit and outputs the internal reference voltage.

21. The internal voltage generator of claim 13, wherein the first driver is deactivated when the half-internal voltage is larger than the internal reference voltage although the detection signal is enabled.

* * * * *